United States Patent [19]

Baum

[11] 4,024,902

[45] May 24, 1977

[54] METHOD OF FORMING METAL TUNGSTEN CARBIDE COMPOSITES

[76] Inventor: Charles S. Baum, 34108 E. Jefferson, St. Clair Shores, Mich. 48082

[22] Filed: Mar. 18, 1976

[21] Appl. No.: 668,265

Related U.S. Application Data

[63] Continuation-in-part of Ser. No. 578,122, May 16, 1975, abandoned.

[52] U.S. Cl. ..... 164/97; 164/100; 75/240; 75/123 CB; 75/123 K

[51] Int. Cl.[2] ..... B22D 19/02

[58] Field of Search ..... 164/55, 57, 58, 97, 164/98, 100; 29/182.1, 182.7; 75/200, 203, 204; 148/34

[56] References Cited

UNITED STATES PATENTS

| | | | |
|---|---|---|---|
| 3,149,411 | 9/1964 | Smiley et al. | 29/182.7 X |
| 3,175,260 | 3/1965 | Bridwell et al. | 164/97 |
| 3,258,817 | 7/1966 | Smiley | 164/97 X |

*Primary Examiner*—Ronald J. Shore
*Assistant Examiner*—Gus T. Hampilos
*Attorney, Agent, or Firm*—Krass & Young

[57] ABSTRACT

Composites consisting of sintered tungsten carbide particles in a local matrix of a steel alloy having a carbon, cobalt and tungsten content are prepared by placing particles of tungsten carbide with cobalt binder, at least some of which are larger in size than those desired in the final composite in a mold. Matrixing alloy having little or no tungsten content is heated above its melting temperature and then poured into the relatively cold mold. The carbon, tungsten and cobalt dissolve at the outer surfaces of the particles and diffuse into the alloy which is allowed to naturally cool and solidify.

11 Claims, 4 Drawing Figures

METHOD OF FORMING METAL TUNGSTEN CARBIDE COMPOSITES

REFERENCE TO RELATED APPLICATIONS

This application is a continuation-in-part of application Ser. No. 578,122, filed May 16, 1975 now abandoned.

BACKGROUND OF THE INVENTION

1. Field of the Invention

This invention relates to methods of forming articles consisting of particles of sintered or cast tungsten carbide disposed in a tungsten, carbon steel alloy matrix and to composite structures formed by this method.

2. Prior Art

Composites consisting of sintered or cast metallic carbide particles or chunks supported in a matrix of a more resilient metal are often employed in high wear applications. The wear resistance of the sintered particles is complemented by the toughness of the matrix to form a material that is more abrasion resistant than the matrix material and can withstand impact loads better than the sintered carbide.

Articles formed from these composite materials are used in applications where they are subjected to regular contact with hard, abrasive materials as conventional materials either wear too quickly or lack the impact resistance to withstand use over a long period. For example, they may be employed in ore treatment plants as chutes, or as facings on rock drills. They may also be employed in security applications such as for locks and safes because of their resistance to penetration by drills and like tools.

The failure mode of the composites in high abrasion typically involves the erosion of the matrix portion of a surface until a substantial portion of a sintered particle is exposed, and then the tearing away of that particle from the matrix. Efforts to improve the composite to minimize this failure mode have been directed toward use of harder matrix materials to minimize their erosion. But this usually increases the brittleness of the matrix making it easier for a particle to break away by cracking at the matrix-particle interface.

Previous efforts to form composite materials consisting of tungsten carbide particles in a softer metal matrix have been directed toward avoidance of any dissolving of the tungsten carbide or deterioration of the sintered material as a result of the heat of the molten matrix. In most applications matrixing alloys have been used with melting points substantially below about 2650° F, the temperatures at which components of the tungsten carbide begin to diffuse into the alloys. Typically, copper based alloys have been employed for the matrix because of their low melting temperatures in the range of 1900° to 2100° F. In applications where a harder matrixing material is required, using metals with melting temperatures close to the temperature at which the metallic carbide dissolves, attempts have been made to very carefully control the temperature at which the composite is formed to minimize the amount of sintered material dissolved in the matrix. For example, U.S. Pat. Nos. 3,175,260 and 3,149,411 disclose methods wherein the steel matrix is heated to a temperature only sufficient to allow it to be poured over and infiltrate the tungsten carbide particles disposed in a mold. The particles are preheated to this infiltration temperature and the composite is maintained at this temperature for a sufficient time after pouring to insure thorough infiltration of the particle mass by the matrix material.

SUMMARY OF THE INVENTION

The present invention is directed toward a method of forming these composites which results in a substantially harder, stronger body than the prior art methods, and to articles formed by the method of the present invention. Unlike the prior art methods which attempt to avoid dissolution of the metallic carbide components into the matrixing alloy, the present invention is directed toward materials having zones of alloy strengthened by the inclusion of the dissolved constituents of the metallic carbides. The present invention broadly contemplates the placement of tunsten carbide particles of a substantially larger size than those desired in the finished article, in a mold in which the composite article is to be formed. A steel alloy is separately heated to a temperature of at least about 2850° F, and at least about 250° F above the melting temperature of the matrix alloy. The molten alloy is then poured into the mold which is relatively cold; i.e., below the melting temperature of the alloy and the temperature at which the metallic carbide dissolves.

Tungsten carbide will dissolve in any iron alloy at 2650° F or higher (the practical sintering temperature). Accordingly, as long as the poured alloy has a temperature in excess of about 2650° F when it has infiltrated the particles, the surfaces of the particles dissolve in the steel and diffuse into the molten alloy. This dissolution continues until the matrix cools below 2650° F, or the sintered material is completely dissolved. To avoid such complete dissolution the present invention utilizes either tungsten carbide particles having combinations of volume and surface area which prevent their dissolution before freezing of the matrix. These may involve use of at least some relatively large sintered particles in the mold which only partially dissolve before the matrix cools below 2650° F, or a relatively large quantity of smaller particles, or some combinations thereof. Some of the particles may completely dissolve before freezing. The size and placement of the particles must be balanced with the pour temperature of the matrix, the initial temperature of the mold, and the volume and surface area of the mold to insure that the heat of the matrix causes a dissolving action at the surface of the particles but at least some of the particles still exist, in reduced size, when the matrix freezes. The dissolving action reduces the size of these tungsten carbide particles which remain after freezing and also surrounds the remaining particles with a strong but somewhat ductile shield, termed a "diffusion zone" which allows the particles to resist forces that would tend to tear them out of the matrix. This zone also forms a metallurgical bond between the remaining particles and the matrix. The diffusion of the carbon, tungsten, and cobalt (or other binder) through the alloy also produces an alloy having superior properties, including greater strength, than the original poured alloy. This method may be used with sintered or cast tungsten carbides having a binder, normally cobalt, consisting of from about 2 to 25% by weight of the carbide.

The proportion of dissolved metallic carbide particles in the final composite may be increased, and the solubility of these particles controlled by the inclusion of some smaller sintered particles (fines) that totally dissolve before the poured metal solidifies. When they ;o into solution in the alloy they decrease it solubility 'or the constitutents of the remaining particles and cool he poured metal to limit the degree to which the re-naining particles go into solution.

The resultant material has excellent wear resistant ›roperties resulting from the hardness of the carbide ›articles and the tungsten steel matrix and from the ıbility of the diffusion zones to prevent dislodgement of he carbide particles from the matrix.

The articles formed in accordance with the present nethod may be classified in terms of the distribution of he sintered particles in the mold, and the finished :omposite, and the dimensions of the diffusion zone urrounding the particles. If the particles are relatively :losely spaced to one another in the mold, and the emperature of the poured matrix is high so as to pro-luce relatively large diffusion zones, the diffusion :ones will merge to form a composite material charac-erized by the sintered particles in a matrix of material ıaving the characteristics of the diffusion zones. Alter-ıatively, if the particles are relatively widely spaced ınd the temperature of the poured metal is relatively ow, so as to produce small diffusion zones, the com-›osite will be characterized by "islands" of the sintered ›articles surrounded by their diffusion zones in a ma-rix having substantially the cast alloy.

The particles may also be heterogeneously dispersed vithin the mold so as to produce a first region, devoid ›f particles, and having the characteristics of the ›oured matrix, and a second region containing the ›articles surrounded by their diffusion zones, and vherein the diffusion zones are either merged to form ı continuous matrix, or take the form of islands sur-ounded by the essentially unalloyed, cast matrix. The ıse of fine particles which completely dissolve during he molding can control the extent of the diffusion :ones.

Because the alloy is heated substantially above the nfiltration temperature in the method of the present nvention, if the mold and its sintered carbide were ›reheated to the infiltration temperature and held at his infiltration temperature for any appreciable period ›f time after the alloy was poured, total disintegration ›f the sintered particles would occur. Accordingly, in he method of the present invention the mold and sin-ered particles must be relatively cool when the alloy is ›oured, and the poured composite must be allowed to reeze, immediately after the pour. In this manner, the legree of dissolution of the sintered particles is con-rolled by the pouring temperature of the alloy, the ıold temperature, the relative proportions of alloy and intered carbide, and the surface area of the carbide. ıs a practical matter the mold must be at least a few .undred degrees below 2650° F, the melting tempera-ıre of the sintered carbide; i.e., no higher than about 200° F.

In essence, the method of the present invention dis-ınguishes from previous methods which employed ·on, nickel or cobalt based alloys as a matrix material ›r cobalt bonded sintered tungsten carbide particles in ıat the particles placed as inserts in the mold are sub-tantially larger than those desired in the finished com-osite; the total mass, surface area and position of the articles are controlled to obtain dissolution from the ırface of the particles; the matrix material is poured at temperature of at least 150° F above its "penetration :mperature" or at least 250° F above its melting point ıto a mold; and the poured composite is immediately allowed to naturally cool. The resulting composite material distinguishes from previous composites containing cobalt bonded tungsten carbide particles in an iron alloy matrix or the like in the existence of a relatively large diffusion zone having a high tungsten cobalt and carbon content surrounding the remaining sintered particles to form a wear-resistant but highly resilient shield which strongly resists forces which would tend to tear the particles from the matrix in use.

The composites of the present invention are useful in all of the wear-resistant and security applications. The metallic-carbide particles in the composite are highly drill-resistant and the matrix is substantially more pick-resistant than the softer alloys of the prior art.

The melting temperatures of iron, nickel and cobalt based alloys range between 2400° and 3000° F. When these alloys are melted and poured into a cooler mold containing cooler particles the alloy must be heated somewhat above the melting temperature so that it can fill the mold and the interstices between the particles before it is cooled to a freezing temperature. Typically, this "penetration temperature" ranges from at least 100° to 250° F above the melting temperature of the alloy depending on the relative proportions of the alloy and sintered material. When the alloy is poured at this "penetration temperature" very little diffusion of the tungsten carbide into the alloy occurs because the carbide has no appreciable solubility in the alloy at the resultant temperature of the alloy after it has infiltrated the particles. For the purposes of the present invention the alloy must be heated above the penetration temperature by a sufficient amount to insure partial dissolving of the sintered tungsten carbide particles and diffusion of the dissolved particles into at least a limited area of the molten alloy. This higher temperature of the melt, which will be hereinafter termed the "diffusion temperature" ranges from at least 50° to 300° F above the penetration temperature or at least 150° F above the melting temperature of the alloy.

The upper limits of the "diffusion temperature" are a function of the size of particles or inserts of sintered tungsten carbide placed in the mold and the nature and quantity of the fine particles dispersed in the mold or melt. If larger particles are employed a greater degree of dissolution may be tolerated without completely destroying the sintered tungsten carbide. However, as the dissolving of the sintered tungsten carbide increases the proportion of carbide, cobalt and tungsten in the alloy increases and the upper bound may be set by the degree of brittleness that can be tolerated in the resulting composite. If the finished composite is not likely to be subjected to impact loading a higher degree of diffusion and accordingly a higher alloy temperature can be tolerated.

The "diffusion temperature" which inherently is greater than 2650° F, will vary with the particular matrixing alloy used, the relative proportions of alloy and sintered particles or chunks, and the initial temperature of the mold and its sintered particles at the time of pouring. For example, the required diffusion temperature may be lowered by using a matrixing alloy having a lower melting temperature (but above about 2850° F) by using relatively large proportions of alloy and small proportions of carbide, by preheating the mold and the carbide, or by a combination of these factors. The determination of the dissolving temperature for a particular combination of these factors can be made by preparing small specimen molds, filling them with the carbide particles to be used, and pouring the molten alloys into the molds at various temperature combinations. Metallurgical examination of the resulting specimens after they have cooled will indicate whether the carbon, cobalt and tungsten diffused into the alloy matrix to the desired degree. These tests may include cutting, polishing and etching of sections, the preparation of photomicrographs of these sections and the performance of hardness and impact tests on the sections using conventional instrumentation.

The resilient diffusion zone around the sintered particles permits even distribution of forces imposed on them to the surrounding matrix. Even if the portion of the zone at the surface of the composite wears away so that the sintered particles stand out from the remaining composite surface and are subjected to larger than usual forces because of this prominence, the strong and resilient region below the surface prevents the particle from being torn out of the composite by these forces.

If the carbide particles are spaced sufficiently close to one another in the mold the diffusion zone will fill the volume between the remaining particles in the composite.

The resultant composites will have an extremely high wear resistance and excellent impact resistance which far surpasses that of previously known composites. When used in such high-wear, high-impact applications as ore or refuse crushing hammers the composites provide several times the life of components formed from conventional materials. By way of example, a hammer for a crushing mill for refuse, formed of a composite of the present invention, had a service life of 3000 tons of refuse as compared to the typical service life of 300 tons for hammers of the same configuration formed of austenitic manganese steel.

The particles used in forming the composites may be homogeneously dispersed about the mold so that the resulting composites have a homogeneous composition. Alternatively, the particles may be positioned in the mold in a heterogeneous manner to form a composite wherein certain sections have the same composition as the poured alloy and other sections contain sintered particles in a local matrixing alloy that is influenced by the diffused components of the sintered material. In this manner the metallurgical characteristics of different sections of the part by may be tailored to the functions of those sections. For example, the hammer previously mentioned may be formed with sintered carbide particles adjacent the surfaces that impact the refuse and the sections that connect the hammer to the mill mechanism may be formed of tougher, less brittle metal, or the lock area of a safe door may be covered with a drill resistant coating.

The proportion of the sintered components which dissolve in the poured alloy can be controlled by adding fine sintered particles directly to the molten alloy either in the melting furnace or the ladle, before it is poured into the mold. By increasing the tungsten and carbon content of the matrixing alloy the solubility of these components into the poured matrix are reduced. This also decreases the thickness of the diffusion zone which surrounds the remaining sintered carbide particles in the composite and increases the carbon and tungsten content of the matrix portion of the composite.

The tungsten carbide particles used with the present invention may range upwardly in size to relatively large sintered sections which may be considered inserts in the final composite part. Typical ranges of the particle sizes, for composites formed in accordance with the present invention are : −2 inch/+1 inch; −1 inch/+½ inch; −½ inch/+⅜ inch; −⅜ inch/+50 mesh. When sintered fines are employed to raise the carbide and tungsten content of the matrix alloy typically 50 mesh to +100 mesh are employed.

The carbides used are tungsten carbide with a binder, typically cobalt or nickel, ranging from about 3 to 25% by weight of the composition. In addition to the primary tungsten carbide constitutent the cemented carbides may contain smaller amounts of titanium or tantalum or the like. These cemented carbides may be derived by crushing scrap sintered carbide cutters, inserts and the like. They will typically have a hardness of 70 to 90 Rockwell C.

The carbide particles may be randomly distributed in the mold before pouring of the matrixing alloy where the composite to be formed has a homogeneous structure or they may be positioned and mechanically anchored in the manner of inserts when the composite is to have concentrations of sintered particles at particular locations.

The matrix material may be pure iron, nickel or cobalt but will preferably be alloys based upon these metals. The carbon, cobalt and tungsten which diffuse into the molten alloy from the sintered particles during the freezing of the molten alloy in the mold increase the hardness of the resulting alloys in the diffusion zone. The alloy will preferably have at least 70% iron, nickel or cobalt, or a combination of these metals. Any of the common alloying metals may provide the other constituents, depending upon the application of the composite part.

The composites may be poured in carbon crucibles or sand molds. When the sand molds are used relatively large carbide particles or chunks may be positioned in the mold by attaching nails or pins to the chunks and burying the extending ends of these fasteners into the sand. The nails or pins may be attached to the chunks by brazing or cementing.

The nature and object of the invention will be made apparent by the following detailed description of several preferred embodiments of the invention. The description makes reference to the accompanying drawings in which.

EXAMPLE I

Figure 1:
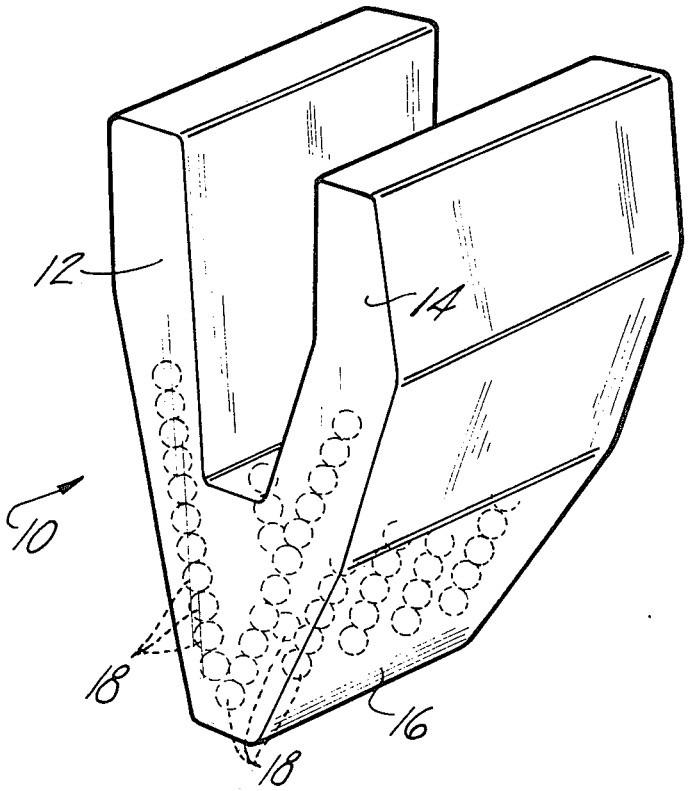
FIG. 1 is a perspective view of a scraper tooth for a bulldozer or the like formed in accordance with the present invention, with sections broken away to illustrate the configuration of the sintered insert.

A scraper tooth for a bulldozer, generally indicated at 10, formed of a composite made in accordance with the present invention, is illustrated in FIG. 1. The tooth 10 consists of a pair of elongated sections 12 and 14, joined at one end to form a hardened cutter tooth 16. The sections 12 and 14 are adapted to join the tooth to the blade of the bulldozer and accordingly must be relatively ductile to avoid their cracking or abrading the mating blade section. The end and sides of the tooth 16 must be extremely hard so as to resist the abrading forces of rocks and the like and yet must be impact resistant.

The tooth is prepared by forming a female sand mold and lining the edges of the mold along the sections that form the tooth ends 16 with rows of tungsten carbide sections of ball shape. Alternatively, long strips could be used. In the preferred embodiment of the invention the tooth has a total length of about 9 inches and the sections 12 and 14 have the thickness of about 1 inch. The carbide inserts take the form of half-inch diameter balls produced by crushing scrap tungsten carbide cutters and the like in a cage mill. The milling action breaks off the sharp angular edges of the smashed particles to produce substantially rounded shapes. Short nails are attached to the shapes by brazing or cementing the nail heads to the particles and the balls are secured in the sand mold for burying the nails in the sand. The balls are aligned in rows on the mold sides in the approximate positions indicated by the dotted circles 18 on the illustration of the completed part. The sintered tungsten carbide balls preferably have a 12% by weight cobalt binder content. They may have trace elements of titanium or tantalum.

SAE 1010 mild steel is then melted and heated to 3100° to 3150° F in an electric induction furnace. The molten steel is then poured into the mold which may have been heated to about 500° F, and the mass is then allowed to cool immediately in a 70° F atmosphere. The volume of the molten steel to fill the mold is approximately 4–8 times the volume of the ball inserts. The molten steel readily fills the mold and the interstices between the balls and causes some dissolving of the surface of the balls. The dissolved carbon, cobalt and tungsten diffuse for a substantial distance through the molten steel until the steel freezes.

Analysis of the resulting composite part indicates that approximately 5% of 25% of the volume of the original carbide particles has dissolved and diffused into the steel matrix and that a good metallurgical bond, much stronger than mechanical entrapment, is formed between the remaining sintered particles and the alloyed steel. Upon destructive testing of the sections of the formed tooth in the area of sintered inserts, failure of the structure in the brittle mode may be observed indicating that there is substantial alloying of the carbon, cobalt and tungsten into the mild steel.

Figure 3:
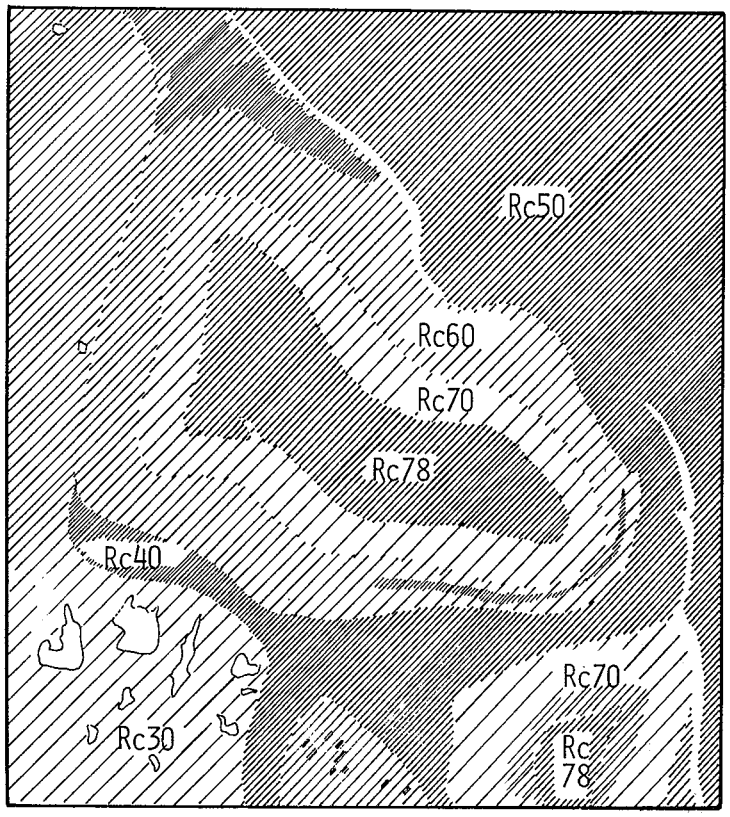
FIG. 3 is a schematic diagram in the nature of a photomicrograph through a sintered tungsten carbide particle in the finished composite illustrating the different metallurgical regions resulting from the diffusion of the sintered material into the alloying matrix; and, FIG. 4 is an actual photomicrograph of a region similar to that illustrated in FIG. 3.
Figure 4:
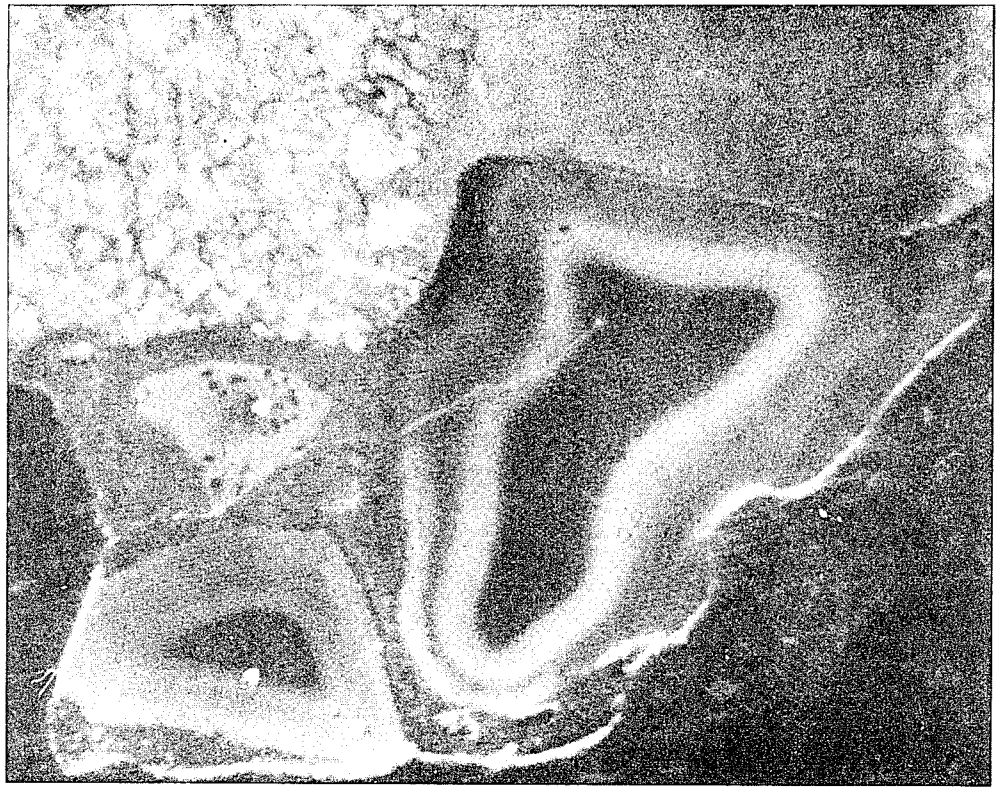

The resulting composite has characteristics of mild steel at the blade engaging ends and the combined characteristics of the extremely hard sintered tungsten carbide (60–90 Rockwell C) in a matrix of harder but yet resilient steel at the tooth end. As shown in the photomicrographs of FIGS. 3 and 4, which represent a different specimen, a shell of relatively hard resilient materials surround and protect each sintered particle.

EXAMPLE II

Figure 2:
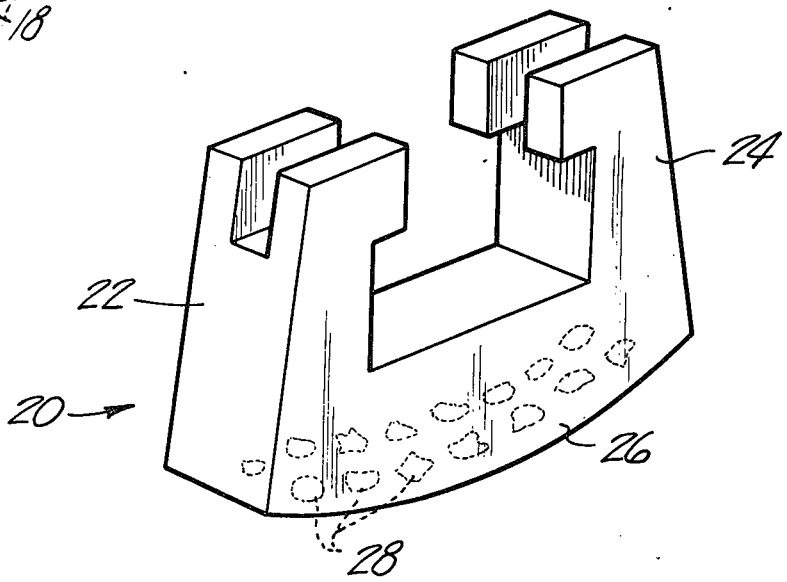
FIG. 2 is a perspective view of a hammer for a hammer will formed in accordance with the present invention.

A hammer for use in a garbage and refuse crushing hammer mill, formed of a composite made in accordance with the present invention, is illustrated in FIG. 2. The hammer, generally indicated at 20, has a pair of arms 22 and 24 which engage holding mechanisms and a head 26 which acts as the hammer and is subjected to the impact of the refuse or garbage. Angular carbide chunks were inserted into the sand mold by use of cemented nails in the positions indicated by the dotted line 28 in FIG. 2. The hammer face has an area of 6 by 6 inches and the carbide was in the form of ¾ and ⅜ inch balls. Scrap steel containng 13% manganese was melted at approximately 3050° F and 1% manganese was then added to compensate for melting losses. The molten metal was then poured into the mold which was at room temperature. Immediately after the casting operation, the hammers were allowed to cool at room temperature. After cooling they were heat treated by heating them to 1900° F and holding for ½ hour and then quenching in water.

EXAMPLE III

A hammer having substantially the configuration of the hammer of FIG. 2 was formed by employing manganese steel scrap at a temperature of 3150° F. The steel had the following composition:

Carbon — 1.14%
Manganese — 13.00%
Silicon — 0.73%
Chromium — 0.74%
Nickel — 1.20%
Iron — Balance Approximately 3% by weight of sintered tungsten carbide fines having a range of 4 mesh to 30 mesh and dissolved in the molten steel.

The positions in the mold indicated by the dotted lines 28 in FIG. 2 were then lined with +½ inch −⅜ inch sintered carbide grit and the molten steel with the dissolved fines was poured into the mold at room temperature. The composite mass was immediately allowed to naturally cool.

EXAMPLE IV

A hammer may be formed as in Example III with the fines disposed in the mold rather than in the melt.

FIG. 3 is a schematic diagram representative of a section of composite formed in accordance with the present invention illustrated in the actual photomicrograph of FIG. 4. The photomicrograph represents a composite having one area containing sintered particles in sufficient proximity to one another that the resulting diffusion zones formed a continuous matrix for the particles, and another area of the mold sufficiently devoid of sintered particles so that the character of the opposite is essentially that of the poured matrix metal.

The sintered particles remaining in the finished composite have a hardness of Rockwell C 78. The matrix which surrounds them appears to have three regions with hardness of Rockwell C 70, Rockwell C 60 and Rockwell C 40. These areas merge to form a continuous diffusion zone. The basic poured metal is indicated at the lower left and has a hardness of 30 measured on the Rockwell B Scale.

EXAMPLE V

A security test bar was formed by placing 1.75 pounds of 20/30 mesh sintered tungsten carbide particles in a sand mold having a 1 by 3 by 6 inch mold cavity.

Manganese steel was heated to about 3050° F and 2.25 pounds were poured into the mold, which was at room temperature. The mold was allowed to naturally cool for 1 hour and it was then heat treated by heating to 1800° F, holding for one-half hour, and then quenching with water.

The resultant test bar exhibited excellent resistance to attach by drills and punches used in accordance with Underwriters Laboratories standards.

EXAMPLE VI

A security test bar was formed in the same manner as the bar of Example V except that 4/6 mesh sintered tungsten carbide particles were employed in the mold, rather than the finer mesh of Example V. This bar also exhibited excellent security properties.

The embodiments of the invention in which an exclusive property or privilege is claimed are defined as follows:

1. The method of forming a metal tungsten carbide composite comprising: supporting a plurality of cobalt bound tungsten carbide particles having a mesh size of an average size substantially larger than the tungsten carbide particles desired in the finished composite within a mold; separately heating a metal, to between 2800° and 3200° F; pouring the metal into the mold while the particles are at a temperature below about 2200° F and immediately allowing the mass to cool and solidify to cause solution of the sintered tungsten carbide into the metal from the surfaces of the particles and diffusion of the carbide components to produce a composite having reduced size sintered tungsten carbide particles therein surrounded by zones of high tungsten, carbon and cobalt content metal alloy.

2. The method of claim 1 wherein the metal consists of a steel alloy.

3. The method of claim 1 wherein at least certain of the tungsten carbide particles have a mesh size greater than 50.

4. The method of claim 1 wherein the sintered tungsten carbide has a cobalt binder containing from 3 to 25% cobalt.

5. The method of claim 1 wherein the mold is maintained in an unheated environment of pouring.

6. The method of claim 1 wherein the particles are heterogeneously dispersed in the mold, whereby a composite is created having first regions wherein the composition of the final composite is substantially identical to the composition of the poured metal, and second regions wherein the composition of the composite is influenced by the infusion of the constituents of the sintered carbide particles.

7. The method of forming a composite material, comprising: supporting a plurality of first particles of tungsten carbide having a cobalt binder, of size greater than 4 mesh, and of a larger size than the particles desired in the final composite in a mold; maintaining the temperature of the mold and the particles at less than about 2200° F; heating a metal having at least 70% iron, nickel or cobalt content to at least 200° F above its melting temperature, and above about 2650° F, separately from the mold; pouring the molten metal into the mold; and immediately allowing the casting thus formed to naturally cool to produce a composite having reduced size sintered tungsten carbide particles therein surrounded by zones of high, tungsten, carbon and cobalt content metal alloy.

8. The method of claim 7 wherein at least certain of the first tungsten carbide particles have an average size greater than 50 mesh and are larger than the particles desired in the finished composite.

9. The method of claim 7 wherein the temperature of the molten metal is sufficiently low to prevent the total dissolution of the sintered particles in the poured metal.

10. The method of claim 7 including dissolving second tungsten carbide particles of a size smaller than 4 mesh in the metal before it is poured into the mold.

11. The method of claim 7 including the step of supporting a plurality of second particles of tungsten carbide of a size smaller than 50 mesh in the mold.

* * * * *

UNITED STATES PATENT OFFICE

CERTIFICATE OF CORRECTION

Patent No. 4,024,902 Dated May 24, 1977

Inventor(s) Charles S. Baum

It is certified that error appears in the above-identified patent and that said Letters Patent are hereby corrected as shown below:

Column 3, line 1 "it" should be --its--.

Column 5, line 46 delete "by" after "part".

Column 6, line 51 "will" should be --mill--.

Column 8, line 47 "opposite" should be --composite--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*